US007051530B2

(12) United States Patent
Blomeyer

(10) Patent No.: US 7,051,530 B2
(45) Date of Patent: May 30, 2006

(54) BURNER APPARATUS FOR BURNING FUEL AND AIR

(75) Inventor: Malte Blomeyer, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 61 days.

(21) Appl. No.: 10/670,806

(22) Filed: Sep. 25, 2003

(65) Prior Publication Data

US 2004/0055308 A1 Mar. 25, 2004

Related U.S. Application Data

(63) Continuation of application No. PCT/EP02/05314, filed on May 14, 2002.

(30) Foreign Application Priority Data

May 18, 2001 (GB) ..... 0112147.4

(51) Int. Cl.
*F23D 14/62* (2006.01)
*F23R 3/12* (2006.01)

(52) U.S. Cl. ..... 60/737; 60/748; 60/725; 431/182; 431/114

(58) Field of Classification Search ..... 60/737, 60/748, 725, 39.23; 431/182, 183, 114
See application file for complete search history.

(56) References Cited

U.S. PATENT DOCUMENTS 5,451,160 A * 9/1995 Becker ..... 431/183
5,558,515 A 9/1996 Althaus et al.
5,638,682 A 6/1997 Joshi et al.
5,676,538 A * 10/1997 Lovett ..... 431/182
5,758,587 A 6/1998 Buchner et al.
6,056,538 A 5/2000 Buchner et al.
6,152,724 A 11/2000 Becker
6,158,223 A * 12/2000 Mandai et al. ..... 60/737
6,189,320 B1 * 2/2001 Poeschl et al. ..... 60/737
6,196,835 B1 3/2001 Gutmark et al.
6,594,999 B1 * 7/2003 Mandai et al. ..... 60/725

FOREIGN PATENT DOCUMENTS

| | | |
|---|---|---|
| DE | 44 15 916 A1 | 11/1995 |
| DE | 198 39 085 C2 | 3/2000 |
| EP | 0 589 520 B1 | 3/1994 |
| EP | 0 193 838 B1 | 9/1996 |
| EP | 0 925 470 B1 | 6/1999 |
| WO | WO 98/35186 A1 | 8/1998 |

* cited by examiner

*Primary Examiner*—Ted Kim

(57) ABSTRACT

The invention relates to a burner apparatus (1) for burning fuel (5) with air (4) to combustion gas, in particular within a combustion turbine, comprising a premixing chamber (3) for premixing fuel (5) and air (4) with. The premixing chamber (3) having an air inlet (8) for air (4) to enter said premixing chamber (3), a fuel inlet (11) for a gaseous or liquid fuel (5) to enter said premixing chamber (3), and an outlet (12) for a mixture of air (4) an fuel (5) wherein, the fuel inlet (11) being located between said air inlet (8) and said outlet (12). The burner apparatus (1) Further comprises at least one air blocking member (2) situated at the air inlet (8) for stabilising a burner premixing flame by locally blocking the flow of air (4) entering said premixing chamber (3) so that downstream said outlet (12) a locally inhomogeneous fuel concentration (23) results generating a locally hot stream of combustion gas being hotter than the average flame temperature.

21 Claims, 3 Drawing Sheets

BURNER APPARATUS FOR BURNING FUEL AND AIR

CROSS REFERENCE TO RELATED APPLICATIONS

This application is a continuation of International Application No. PCT/EP02/05314, filed May 14, 2002 and claims the benefit thereof. The International Application claims the benefits of Great Britain application No. GB 0112147.4, filed May 18, 2001, both applications are incorporated by reference herein in their entirety.

BACKGROUND OF THE INVENTION

1. Field of the Invention

The invention relates to a burner apparatus for burning a fuel in air and for stabilising a premixing flame, in particular a burner apparatus for a combustion turbine. The apparatus includes a premixing chamber in which fuel and air are premixed prior to burning the fuel.

2. Description of Related Art

Under the designation "premix burner" a burner device is known to persons skilled and active in the relevant art, with the feature that the fuel is burned only with a certain time interval after its intermixing with the air provided for the combustion.

During the operation of a conventional premix burner, when the feeding of fuel to the burner is increased, a state is often reached in which the combustion becomes unstable and acoustic vibrations are caused in the plant into which it is fitted. The acoustic vibrations are known by the term "combustion vibrations". The combustion vibrations may be so great that they jeopardise the operation of the premix burner and the plant, of which the premix burner is an integral part. The tendency of a premix burner to form unstable combustion becomes all the greater, the more homogenous the mixture of fuel is and the air formed in the premix burner before the combustion. However, a mixture which is as homogeneous as possible is desired in view of the fact that the production of nitrous oxides during the combustion is lower, the more homogenous is the mixture. If the mixture is completely homogenous, the maximum temperature occurring during the combustion of the mixture assumes a minimum, and it is precisely this effect which is essential for an especially low production of nitrous oxides. European Patents EP 0 193 838 B1 and EP 0 589 520 B1 disclose such a device.

To stabilise the combustion of a premix burner, it has been proposed in U.S. Pat. Nos. 5,758,587 and 6,056,538 to Büchner et al to envelope the igniting mixture flowing from the burner with a veil of air and thus prevent vortices from forming in marginal regions of the mixture, in which vortices combustion processes take place, from which it may be assumed that they contribute substantially to the destabilisation of the combustion. This is achieved with the disadvantage of extracting air which is used to envelope the mixture from the actual combustion operation which markedly may increase the formation of nitrous oxides.

U.S. Pat. No. 6,152,724 which corresponds to European Patent 0 925 470 B1 describes a device for burning a fuel in air. This device includes a body having an axis and an annular passage formed therein for directing air in a meridional flow with regard to the axis; a swirl cascade connected to the body and imposing a swirl on the flow; an air flow delayer connected to the body and delaying a portion of the flow lying radially on an outside with regard to the axis relative to other portions of the flow; and a mixer connected to the body and intermixing fuel with the flow for forming a substantially homogeneous air/fuel mixture. The velocity in the flow, when the latter discharges from the device, is configured non-uniformly in the radial direction with regard to the axis. This is effected by the flow being locally disturbed in the annular passage by an appropriate obstacle in the form of a screen or the like, which is disposed at an appropriate point in the annular passage. But at the same time the homogeneity of the mixture of air and fuel in the flow is retained.

German Patent DE 198 39 085 C2 relates to a burner device for a firing installation, in particular a combustion turbine, with a main burner, which is a premixing burner, and a primary and secondary pilot burner. The primary pilot burner is surrounded by the main burner and centred with respect to the main axis of the main burner. The secondary pilot burner is placed at the outlet of the main burner, where the mixture of fuel and air enters the combustion chamber. The secondary pilot burner provides additional fuel through a number of orifices at the outlet of the main burner, which leads to a non-uniform contribution of fluid at the outlet of the main burner. To achieve this the installation of additional pipes for providing fluid a well as further mechanical features are necessary which makes the burner device more complicated and spacious.

International Patent Application WO 98/35186 A1 relates to an active method to suppress combustion vibrations in a combustion turbine plant. This method for active attenuation of a combustion oscillation in a combustion chamber uses at least two control elements, wherein an operating lever of the control elements requires the combustion oscillation to be measured only at a limited number of points. This is achieved mainly by using the symmetry of an acoustic vibration generated by self-excitation in the combustion chamber. All active methods to suppress and control combustion vibrations require additional electrical control equipment as well as sensors being exposed to the hot combustion gas.

SUMMARY OF THE INVENTION

It is accordingly an object of the invention to provide a burner apparatus for burning fuel in air that overcomes the above-mentioned disadvantages of the prior art devices and methods of this general type, in which a measure for stabilising the combustion process, in particular in a premix burner, is specified.

With the foregoing and other objects in view there is provided, in accordance with the invention, a burner apparatus for burning fuel in air to a combustion gas comprising a main axis and a premixing chamber for premixing fuel and air. The premixing chamber having an air inlet for air to enter said premixing chamber with a cross-sectional area, a fuel inlet for fuel to enter said premixing chamber and an outlet for a mixture of air and fuel wherein, said fuel inlet being located between said air inlet and said outlet. The burner apparatus further comprises at least one air blocking member situated at the air inlet for stabilising a burner premixing flame by locally blocking the flow of air entering said premixing chamber so that downstream said outlet a locally inhomogeneous fuel concentration results generating a locally hot stream of combustion gas being hotter than the average flame temperature.

The blocking member is a purely passive system for stabilising the flame of a burner, in which fuel and air are pre-mixed prior to burning the fuel. This passive system leads to a stabilisation of the flame within all ranges of operation and not only in the preferred range for normal operation of the burner, in which normal range other systems relying on resonators would work. A stabilisation of the premixing flame is achieved by the at least one hot stream, which is a discrete stream generated by burning fuel in a locally enriched mixture within an almost homogeneous air/fuel mixture. The hot stream is in particular active in a so called recirculation zone in which part of the stream of the combustion gas recirculates in the direction of the burner outlet. Due to the blocking member downstream of the blocking member the flow of air is locally reduced which leads after almost homogeneously injecting of the fuel across the premixing chamber to a locally enrichment of the fuel in the air. This goes with a locally higher fuel/air ratio (FAR). The fuel/air ratio is defined as the actual fuel/air mass ratio divided by the stochiometric fuel/air mass ratio. The air number lambda λ (which is used in Europe) is defined as the inverse of the fuel/air ratio. So the blocking member leads to a locally enriched mixture of fuel in air with a fuel/air ratio still under one (which means a lambda λ number still greater than one) compared to average fuel/air mixture in the premixing chamber. This locally enriched mixture burns in the combustion chamber with a higher burning temperature and therefore leads in the combustion chamber to locally and discrete increased burning temperature which on the other side stabilises the premixing flame and which shifts the lower limit for extinguishing of the flame to a lower fuel/air ratio (which means to higher air number).

Preferably the fuel used is a fluid, in particular a gas, like for example natural gas, or a liquid, like oil. The fuel inlet and all other fuel guiding parts of the burner apparatus are preferably designed for the use of a fluidical—gaseous or liquid—fuel.

To achieve the stabilisation effect in a burner having a premixing chamber no essential change of the method for injecting fuel is necessary, as only the flow of air is influenced to generate an enriched fuel/air mixture. The air blocking member is positioned upstream the premixing zone of the premixing chamber. It delays the portion of the flow of air and so produces a local pressure loss in the flow which causes a lower flow velocity to prevail behind the air blocking member than in the portions of the flow unaffected by the air blocking member. Beside locally and discrete reduction of air flow caused by the blocking member the air flow as well as the mixture of fuel in air is almost homogeneous at the outlet of the premixing chamber.

In a burner design which tends at certain operating conditions to develop combustion induced vibrations the use of an appropriate blocking member according to the invention would furthermore largely suppress the formation of combustion induced vibrations and also reduces the maximum pressure amplitude of those combustion induced vibrations which eventually still develop. The maximum amplitude may be reduced by a factor of four or more. In addition the use of an appropriate blocking member either in a burner design tending to develop combustion induced vibrations or a design free of those vibrations dramatically reduces the amount of carbon monoxide (CO) produced during the combustion process, in particular at higher air numbers. Experiments for example have shown that the emission of CO with 15% Oxygen ($O_2$) can be reduced for air numbers between 3.0 and 3.4 to an amount of less than 200 ppm CO [15% $O_2$]. For air numbers between 2.8 and 3.3 the emission of CO is reduced to less than 100 ppm CO [15% $O_2$].

Number as well as location of the blocking elements and the location between blocking members, if more than one blocking member is used, are to be chosen according to the flow profile to be established. The arrangement of blocking members in the air inlet doesn't have to be symmetrical and may be performed in a way to obtain the best stabilisation effect. It is evident that the passive system of the invention for stabilising the premixing flame maybe easily used for refitting burner apparatus already in use.

A blocking member may be used in a burner in particular for a gas or combustion turbine, a heating installation, a furnace or other firing installations which use a burner having a premixing chamber.

In accordance with another feature the air inlet has in the cross-sectional area an outer periphery and the at least one blocking member is located at the outer periphery.

In accordance with a further feature the at least one blocking member extends towards the main axis.

In accordance with an added feature the at least one blocking member has at the outer periphery a width which width decreases toward the main axis. This design of the blocking element is in particular useful when the air inlet has an annulus cross-sectional area. With the broader section—largest width—the blocking member is easy and secure fastenable at a wall associated with the air inlet. According to the geometry of the burner apparatus and the locations, where it is intended to enrich the air/fuel mixture, blocking members may be installed at other locations and other geometric forms for the blocking members, for example blocking members which broaden to the centre of the burner, may be used.

In accordance with an additional feature the width of the blocking member decreases continuously towards the main axis. Such a blocking member with a continuously decreasing width is particularly easy to manufacture, for example by just cutting out pieces of an appropriate sheet metal.

In accordance with yet another feature the at least one blocking member has a triangular, a trapezoidal or a partially hyperbolic, elliptic or circular shape. With these easy to manufacture shapes the amount of air blocked at the outer periphery is higher than the amount blocked near the main axis, which is in particular useful in a circular or annulus like cross-sectional area of the inlet, in which the total area for throughflow of the air decreases by approaching the main axis. It is understood that also a blocking member with combination of those shaped types as mentioned is possible. The blocking element may be of any appropriate shape.

In accordance with yet an added feature the burner apparatus comprises a pilot burner centred to and extending along the main axis of the burner. The pilot burner may serve for igniting the mixture of fuel and air as well as for maintaining the premixing flame.

In accordance with yet additional feature the burner apparatus extends along the main axis, wherein the premixing chamber comprises a ring channel with the air inlet having an annulus cross-sectional area inclined to the main axis. The burner apparatus further comprises a swirl element disposed in the ring channel for imposing a momentum or swirl to the flow of air. The swirl element further may serve for feeding the fuel in the flow of air. The swirl element may be configured as a swirl cascade which may be an axial, radial or diagonal swirl cascade in accordance with the requirement of the respective individual case. Preferably the fuel is injected in the flow of air by a number of apertures in the swirl element to maintain an almost homogeneous mixture beside those discrete inhomogenities caused by the blocking member. It is understood that in principle the fuel may be fed in any manner, for example via nozzles in the guide vanes of the swirl cascade or via separate mixing devices in front or behind the swirl cascade.

The annulus cross-sectional area is inclined to the main axis, which means that an axis perpendicular to the cross-sectional area encircles an angle of less than 90° with the main axis of the burner apparatus. In fact a number of perpendicular axis on the cross-sectional area (normal axis) form a surface of a cone with an opening angle less than 90° and with the main axis of the burning apparatus as centre axis.

In accordance with a concomitant feature the burning apparatus comprises a regularly perforated plate in the cross-sectional area to which the at least one blocking member is bound. The blocking member may be bound to the plate by welding or any other appropriate method either downstream or upstream the plate. It may also be manufactured together with the plate and so being part of the plate. The regularly perforated plate has a number of apertures which are preferably all of the same size and form a regular pattern in which they are distributed along the plate. The perforated plate causes local pressure losses in the flow of air which lead to a non-uniform distribution of the velocity in the mixture, which flows off into the combustion chamber. This results into a further stabilisation effect. To obtain a largely homogeneous distribution of the fuel in the air the fuel inlet is adjusted in an appropriate manner. For appropriate construction of the fuel inlet computer programs for the numerical calculation of the flow are available to the person skilled and active in the relevant art, the utilisation of which computer programs permit appropriate configuration of the fuel inlet, in particular respective nozzles.

In accordance with again another feature at least four blocking members are distributed irregularly in the cross-sectional area. Those four or more blocking members are distributed in a non symmetric way in the cross-sectioned area. Preferably two of those blocking members are located in close neighbourhood.

In accordance with again a further feature the burner apparatus is part of a combustion turbine which includes a combustion chamber. The burner apparatus is in flow connection with the combustion chamber so that a mixture of air and fuel flows into the combustion chamber and fuel is burnt in the combustion chamber. A combustion turbine—also referred to as a gas turbine—further comprises components like a compressor and rotating blades and guide vanes, which are known to those skilled in the art and therefore not described in more detail.

In accordance with again an added feature the burner apparatus is designed so that during operation in the combustion chamber at least one recirculation zone with recirculating combustion gas develops and the locally hot stream of combustion gas caused by the blocking member lies at least partially within the recirculation zone. The recirculation zone develops at the outer periphery of the outlet of the burner apparatus due to the edges formed at the outer periphery of the burner apparatus and the wall of the combustion chamber.

In accordance with again an additional feature the burner apparatus is designed for operation with a fluidical fuel, in particular a gaseous fuel, like natural gas, or a liquid fuel, like oil. Those fuels are widely used in particular for stationary gas turbines for generating electrical power. Other fuels which may be used for jet engines could also be used. With those fuels a low concentration of $NO_x$ in the exhaust gas is reached to fulfil the more stringent environmental protection regulations.

In accordance with still another feature the at least one blocking member covers less than 30%, in particular between 2% and 20% of the cross-sectional area of the air inlet. So only a small amount of the inlet area is blocked by the blocking element to allow enough air to enter the premixing chamber without changing the behaviour of the burner apparatus.

Although the invention is illustrated and described herein as embodied in a burner apparatus for burning a fuel in air, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
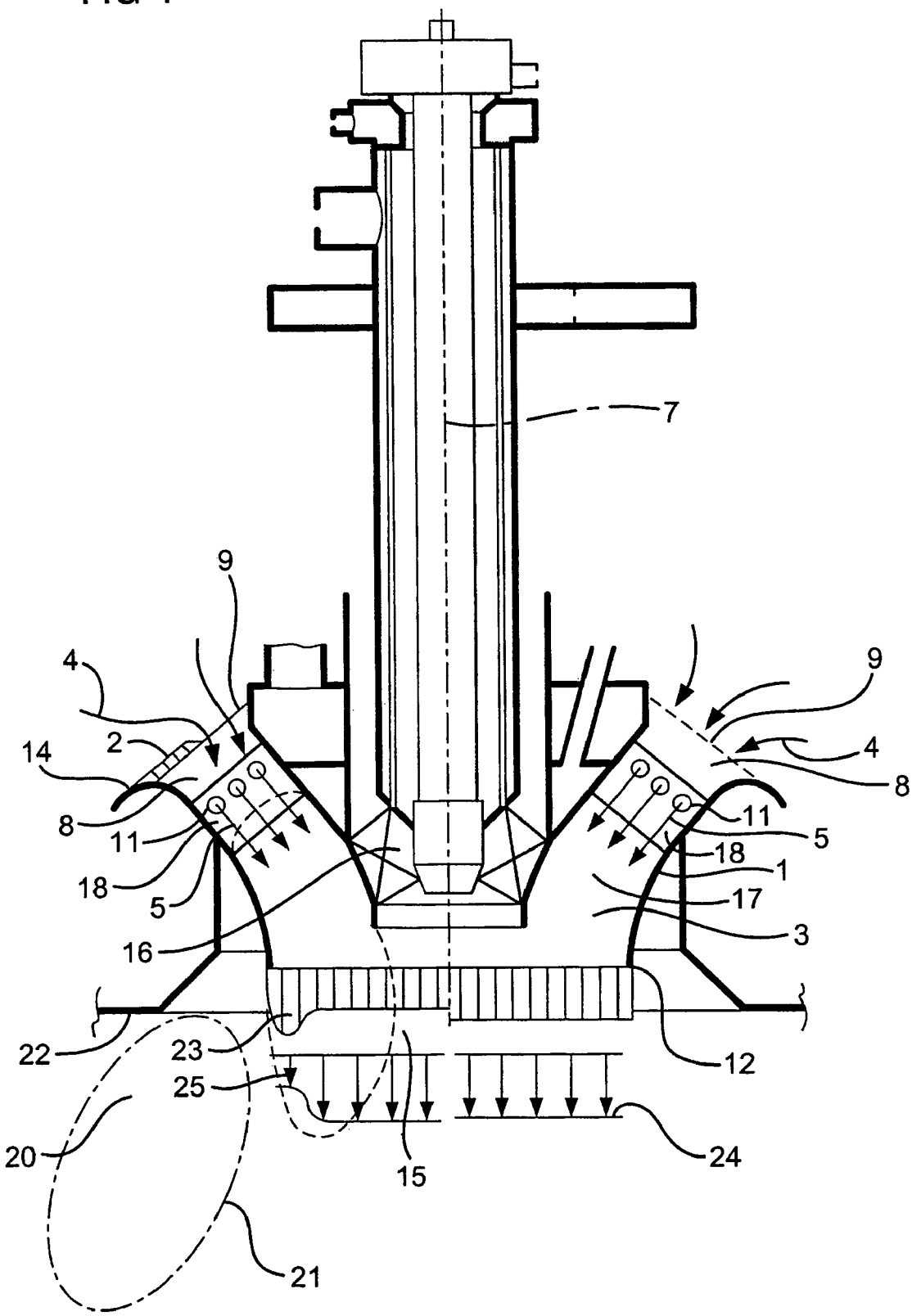
FIG. 1 is a longitudinal sectional view through an embodiment of a burner apparatus according to the invention.

In the figures of the drawing, components corresponding to one another of the respectively shown exemplary embodiments in each case have the same reference numeral.

The drawing is not to be considered as a representation of exemplary embodiments actually realised and is simplified in order to emphasise certain features. The information which can be gathered directly from the drawing can be supplemented for the practical construction within the limits of the knowledge and capability at the disposal of the persons skilled and active in the relevant art with due regard to the explanations preceding this information.

Referring now to the figures of the drawing in detail and first, particularly, to FIG. 1 thereof, there is shown an exemplary embodiment of the burner apparatus 1 according to the invention in a cross-sectional view along a main axis 7 of the apparatus 1.

The burner apparatus 1 extends along the main axis 7 and comprises a premixing chamber 3. The premixing chamber 3 has an annulus air inlet 8. In the air inlet 8 a annulus cross-sectional area 9 is inclined to the main axis 7 by an angle less than 90°. The premixing chamber 3 has a circular outlet 12 centred to the main axis 7. Between air inlet 8 and outlet 12 a swirl cascade with a number of swirl elements 18. Each swirl element 18 extends across a ring channel 17 formed in the premixing chamber 3. For sake of clarity only two swirl elements 18 are shown each of which has a number of fuel inlets 11, in particular formed as nozzles, for feeding fuel 5 to the premixing chamber 3. The premixing chamber 3 surrounds a pilot burner 16 extending along the main axis 7 and centred to the main axis 7. The constructural features of the pilot burner 16 are known to the person skilled in the art and are therefore not described in detail. The pilot burner 16 has among other features an air inlet general with swirl or mixing elements, a fuel pipe and an outlet within the premixing chamber 3.

The burner apparatus 1 is fitted in a wall 22 of a combustion chamber 20. The combustion chamber 20 could be an annulus chamber or a can like chamber and maybe part of a stationary gas turbine for generating electric power, a jet engine, a heating installation, a furnace or any other firing installation.

In the area of the air inlet 8 an air blocking member 2 is provided. FIG. 1 only shows one air blocking member 2, although on the annulus air inlet 8 there may be situated more than one air blocking members 2—for example four—, which could be irregularly positioned in the air inlet 8. The one blocking member 2 is located at the outer periphery 14 of the air inlet 8.

During operation of the burner apparatus 1 a flow of air 4 is fed to the air inlet 8. This flow of air 4 flows through the ring channel 17 and is mixed with fuel 5 provided through the fuel inlet 11 of the swirl elements 18. While flowing through the premixing chamber 3 air 4 and fuel 5 are mixed to form a almost homogeneous air/fuel mixture. This results in a concentration of fuel in this mixture at the outlet 12 which is nearly constant over the area of the outlet 12, where no blocking member 2 effects the flow of air 4 (right portion of the outlet 12 as shown in FIG. 1). Only locally in discrete areas of the outlet 12 (left portion) a higher concentration of fuel 5 is generated. This is due to the air blocking member 2, which blocks a portion of the flow of air 4 at the inlet 8 and leads to a reduction of the amount of air 4 to those areas 23 of the outlet 12 associated with the blocking member 2. These areas 23 have a locally fuel enriched mixture. In areas 23 with enriched fuel concentration therefore also the profile 24 of the flow of the air/fuel mixture is influenced and shows a reduced velocity component 25. Due to the enriched mixture of fuel in area 23 a higher burning temperature is obtained downstream areas 23. Areas 23 are located at the outer periphery of the outlet 12 and are therefore close to the wall 22 of the combustion chamber 20.

Downstream of the swirl element 18 expanding to the outlet 12 a premixing zone 15 is formed. Downstream that premixing zone 15 after burning the fuel 5 a recirculation zone 21 is established. This recirculation zone 21 extends to some amount into the combustion chamber 20 as well as in a direction parallel to the wall 22 of the combustion chamber 20. Burning the fuel 5 of the fuel enriched areas 23 leads to a hot portion of a stream of combustion gas which at least partially enters the recirculation zone 21 and leads locally to a higher temperature in that recirculation zone 21. This has a further stabilisation effect on the premixing flame and completely suppresses or at least significantly reduces the formation of combustion vibrations.

Figure 2:
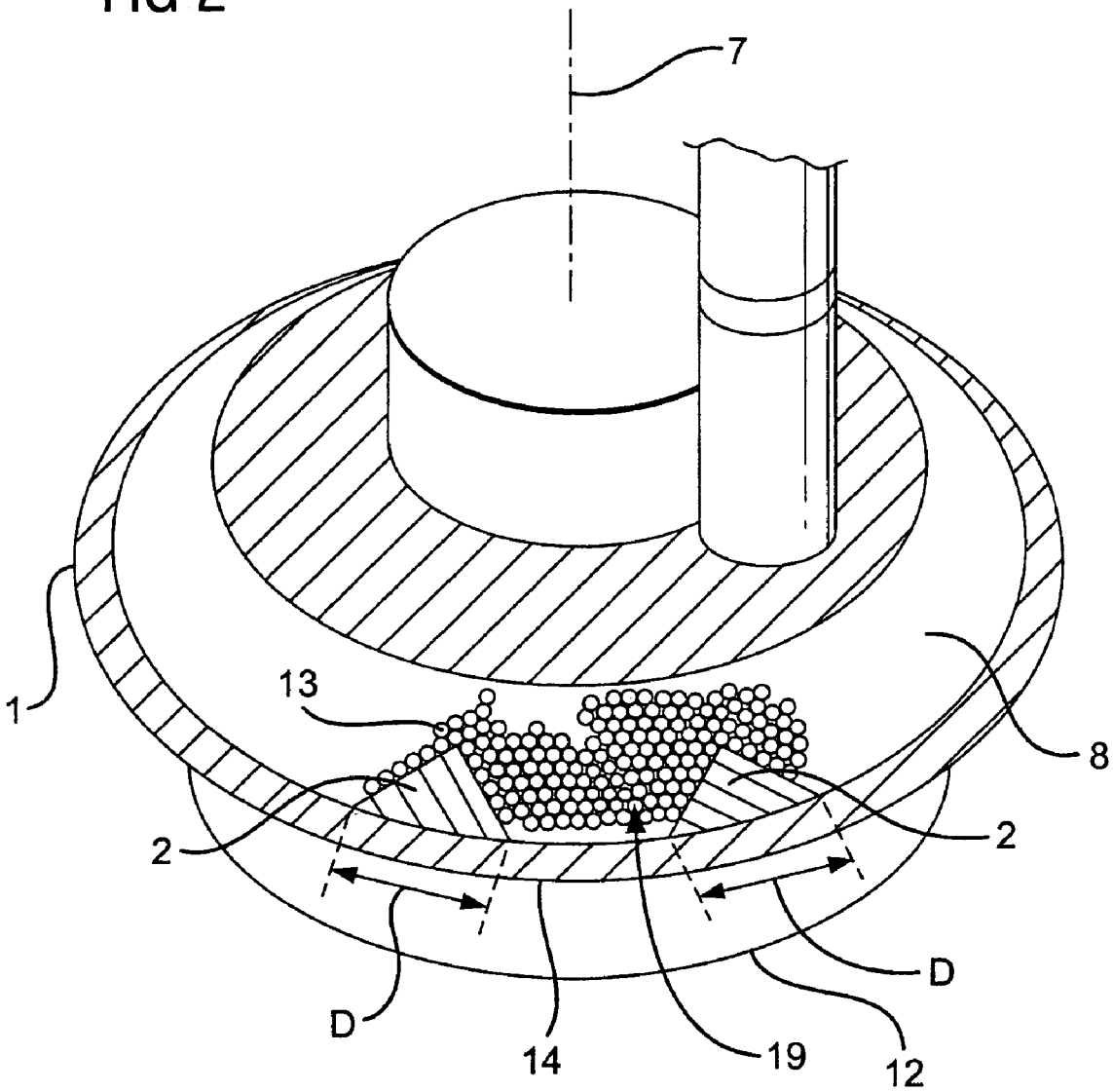
FIG. 2 is a perspective view of a burner apparatus.

FIG. 2 shows a perspective view of a burner apparatus 1 prior to insertion to the combustion chamber 20. In the air inlet 8 a regularly perforated annulus plate 19 is placed. This plate 19 has regularly arranged apertures 13 which allow the air 4 to enter the premixing chamber 3. Two blocking members 2 having a triangular shape are placed on the perforated plate 19. The base side of the triangular block member 2 has the width D. The blocking member 2 is placed on the perforated plate 19 with its base side located at the outer periphery 14 of the air inlet 8. Blocking member 2 maybe welded on the plate 19 or fastened to the plate 19 in any suitable way.

Figure 3:
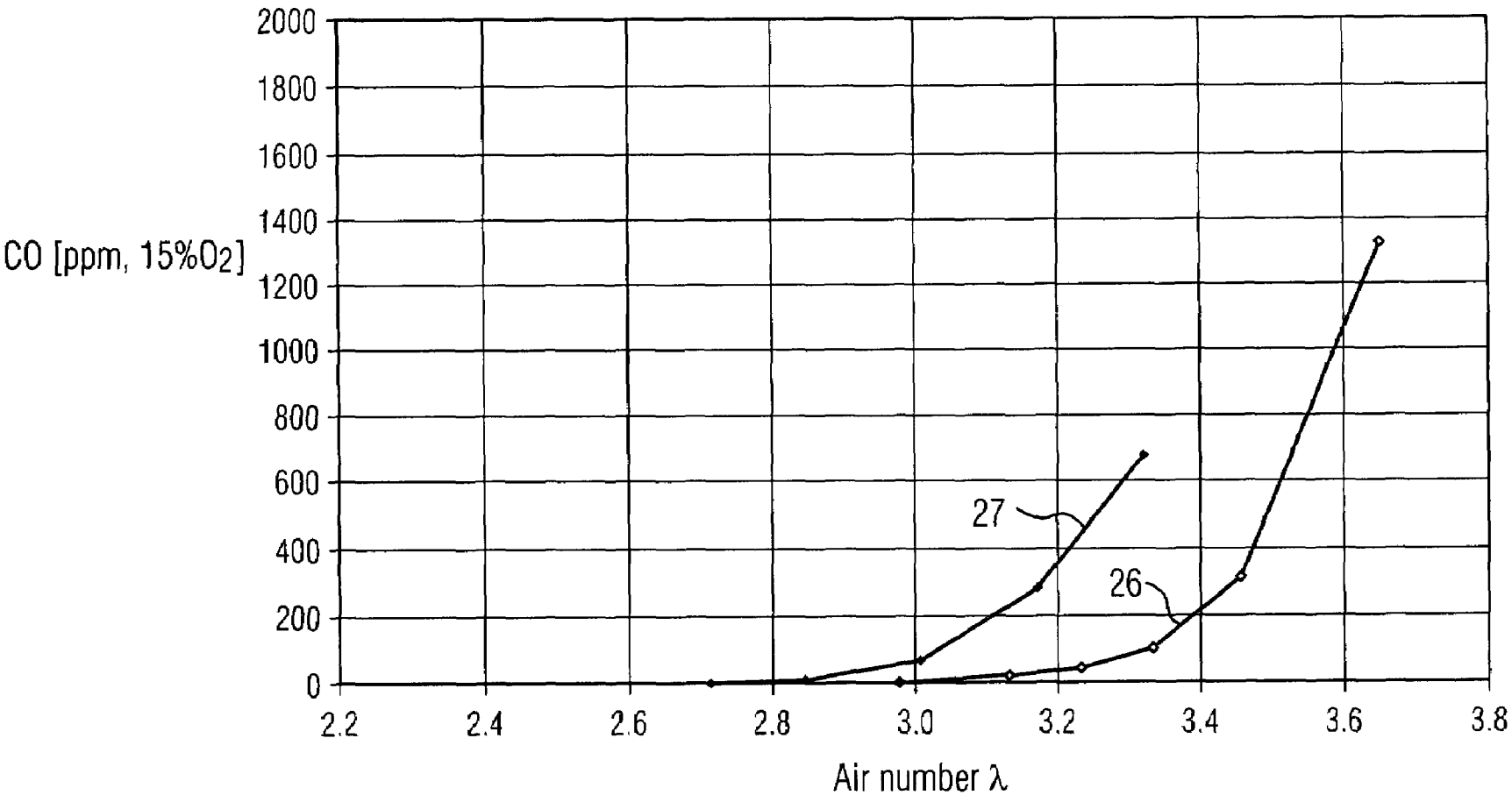
FIG. 3 is a plot showing CO-emissions in dependence of the air number

FIG. 3 shows a comparison of experimental data relating to CO-emission during operation of a burner apparatus 1 with and with out the blocking members 2 as shown in FIG. 2. Curve 27 shows the measured data relating to a burner apparatus without blocking members 2 and curve 26 shows the measured data relating to a burner apparatus 1 with blocking members 2. As can be seen from FIG. 3 the use of blocking members 2 reduces the amount of carbon monoxide (CO) produced during the combustion process, in particular at higher air numbers. The experimental measurements show that the emission of CO with 15% Oxygen ($O_2$) can be reduced for air numbers between 3.0 and 3.4 to an amount of less than 200 ppm CO [15% $O_2$], which is a reduction by a factor 5. For air numbers between 2.8 and 3.3 the emission of CO is reduced to less than 100 ppm CO [15% $O_2$].

All the embodiments of the invention are of particular importance for use in a gas turbine in order to heat a compressed air flow there, provided by a compressor, by burning a fuel, whereupon the heated flow is expanded in a turbine. The invention is distinguished in particular by the fact that, on the one hand, it provides merely passive measures for the stabilisation of combustion and, on the other hand, it requires no branching of air from the air which is otherwise available for the combustion.

The invention claimed is:

1. A burner apparatus for burning fuel and air to a combustion gas comprising:

a premixing chamber for premixing the fuel and the air with an air inlet for the air to enter said premixing chamber and having a cross-sectional area;

a fuel inlet for the fuel to enter said premixing chamber; and an outlet for a mixture of the air and the fuel to exit said premixing chamber, wherein said fuel inlet is located between said air inlet and said outlet, further comprising at least one air blocking member situated at the air inlet which blocks a portion of the air flow and which cooperates with the fuel inlet to create a region having a locally enriched fuel mixture toward a wall of the burner, the locally enriched fuel mixture producing a locally higher combustion temperature effective to suppress a formation of combustion vibrations and to reduce an amount of carbon monoxide produced during combustion when compared to combustion in said burner apparatus with no such air blocking member.

2. The burner apparatus according to claim 1, wherein said air inlet has in said cross-sectional area an outer periphery and said at least one blocking member located at the outer periphery.

3. The burner apparatus according to claim 2, wherein said at least one blocking member extends towards a main axis of said apparatus.

4. The burner apparatus according to claim 3, wherein said at least one blocking member has at said outer periphery a width which decreases towards said main axis.

5. The burner apparatus according to claim 4, wherein said width decreases continuously towards said main axis.

6. The burner apparatus according to claim 5, wherein said at least one blocking member has a triangular, a trapezoidal or a partially hyperbolic, elliptic or circular shape.

7. The burner apparatus according to claim 3, comprising a pilot burner centered to and extending a long said main axis for igniting said mixture of fuel and air.

8. The burner apparatus according to claim 3, comprising a perforated plate in said cross-sectional area to which said at least one blocking member is bound.

9. The burner apparatus according to claim 3, wherein at least four blocking members are distributed irregularly in said cross-sectional area.

10. The burner apparatus according to claim 1, wherein the burner apparatus is located within a combustion chamber of a combustion turbine.

11. The burner apparatus according to claim 10, wherein during operation in said combustion chamber at least one recirculation zone with recirculating combustion gas develops and said locally hot stream of combustion gas caused by said blocking member lies at least partially within said recirculation zone.

12. The burner apparatus according to claim 1, wherein the fuel is a fluidical fuel.

13. The burner apparatus according to claim 12, wherein the fluidical fuel is gas or oil.

14. The burner apparatus according to claim 1, wherein said at least one blocking member covers less than 30% of said cross-sectional area of said air inlet.

15. The burner apparatus according to claim 14, wherein said at least one blocking member cover between 2% and 20% of said cross-sectional area of said air inlet.

16. The burner apparatus according to claim 1, wherein a portion of the recirculation zone develops at the outer periphery of the outlet.

17. The burner apparatus according to claim 1, wherein the blocking member is situated for stabilizing a burner premixing flame by locally blocking the flow of the air entering said premixing chamber so that downstream of said outlet a locally inhomogeneous fuel concentration results which generates a locally hot stream of combustion gas that is hotter than the average flame temperature.

18. The burner apparatus according to claim 1, wherein the blocking members are arranged asymmetrically on the periphery of the air inlet.

19. A burner apparatus for burning fuel and air to a combustion gas comprising:

a premixing chamber having a ring channel for premixing the fuel and the air with an air inlet, the air inlet having an annulus cross-sectional area inclined to a main axis for the air to enter the premixing chamber and having a cross-sectional area, and in the cross-sectional area an outer periphery;

a fuel inlet for the fuel to enter the premixing chamber;

a swirl element disposed in the ring channel for imposing a momentum to the flow of air and for feeding the fuel in the air; and an outlet for a mixture of the air and the fuel to exit the premixing chamber wherein the fuel inlet is located between the air inlet and the outlet and further comprising at least one air blocking member that is situated at the air inlet, located at the outer periphery, and extending towards the main axis of the apparatus, for stabilizing a burner premixing flame by locally blocking the flow of the air entering the premixing chamber and cooperating with the fuel inlet so that downstream of the outlet a locally inhomogeneous fuel concentration results which generates a locally hot stream of combustion gas that is hotter than the average flame temperature and is effective to suppress a formation of combustion vibrations and to reduce an amount of carbon monoxide produced during combustion when compared to combustion in said burner apparatus with no such air blocking member.

20. A burner apparatus comprising:

a premixing chamber receiving a flow of air;

a fuel inlet disposed in the premixing chamber for delivering a flow of fuel into the flow of air;

an air blocking member locally blocking the flow of air upstream of the fuel inlet so that a fuel-air mixture produced at an outlet of the premixing chamber is generally homogeneous except for a discrete region affected by the air blocking member wherein a higher concentration of fuel to air is generated; and a combustion chamber downstream of the premixing chamber and receiving and combusting the fuel-air mixture to produce a combustion gas;

wherein combustion of the discrete region of higher concentration of fuel to air produces a region of locally higher combustion temperature effective to suppress a formation of combustion vibrations and to reduce an amount of carbon monoxide produced during combustion when compared to combustion in said burner apparatus with no such air blocking member.

21. The burner apparatus of claim 20, further comprising:

a recirculation zone established in the combustion chamber; and the air blocking member disposed such that the region of locally higher combustion temperature at least partially enters the recirculation zone.

* * * * *